US011202970B2

(12) United States Patent
Wendorff et al.

(10) Patent No.: US 11,202,970 B2
(45) Date of Patent: Dec. 21, 2021

(54) THROWING TOY WITH CONTACT CONNECTOR HEAD

(71) Applicant: Random Mills, LLC, Morris Plains, NJ (US)

(72) Inventors: Matthew B. Wendorff, Morris Plains, NJ (US); John Kiely, Morristown, NJ (US); Keith Kristiansen, Stratford, CT (US)

(73) Assignee: Random Mills, LLC, Morristown, NJ (US)

( * ) Notice: Subject to any disclaimer, the term of this patent is extended or adjusted under 35 U.S.C. 154(b) by 0 days.

(21) Appl. No.: 16/547,560

(22) Filed: Aug. 21, 2019

(65) Prior Publication Data

US 2020/0061485 A1 Feb. 27, 2020

Related U.S. Application Data

(60) Provisional application No. 62/721,571, filed on Aug. 22, 2018.

(51) Int. Cl.
*A63H 33/18* (2006.01)
*A63H 33/30* (2006.01)

(52) U.S. Cl.
CPC ..... *A63H 33/18* (2013.01); *A63H 33/3072* (2013.01)

(58) Field of Classification Search
CPC ... A63H 33/18; A63H 33/3072; Y10S 273/25; A63B 2225/05; A63B 65/00
USPC ..... 446/177, 473; 273/348.2
See application file for complete search history.

(56) References Cited

U.S. PATENT DOCUMENTS 1,774,765 A 9/1930 Schoen
2,717,442 A * 9/1955 Smith ..... A01B 1/022 30/151
2,738,815 A * 3/1956 Hoeldtke ..... B26B 23/00 30/308.1
3,378,260 A 4/1968 Hartel
3,467,385 A * 9/1969 Liston ..... A63B 65/08 473/590
3,841,628 A * 10/1974 Goldfarb ..... A63F 3/00 273/445
4,030,761 A 6/1977 Daller
4,235,041 A * 11/1980 Sweet ..... A63H 3/36 248/206.4

(Continued)

FOREIGN PATENT DOCUMENTS

GB 2267444 A * 12/1993 ..... A63H 33/18

*Primary Examiner* — Joseph B Baldori
(74) *Attorney, Agent, or Firm* — LaMorte & Associates, P.C.

(57) ABSTRACT

A throwing toy that can simulate the throwing of a weapon. The throwing toy has a head and a handle that are molded from a soft polymeric foam. Reinforcement elements can be molded into the foam to provide structural integrity. The head of the toy has a face surface, a rear surface, a top surface, and a bottom surface. The handle extends from the bottom surface of the head. When the throwing toy is thrown toward a target, one of the surfaces of the head is likely to impact the target. Contact connectors, such as suction cups, are affixed to at least one of the surfaces of the head. The contact connectors are set at different positions and preferably at different angles to provide contact attachments across a wide range of contact angles.

13 Claims, 9 Drawing Sheets

(56) References Cited

U.S. PATENT DOCUMENTS

| | | | | | |
|---|---|---|---|---|---|
| D270,654 | S | * | 9/1983 | Barrett | D22/117 |
| 5,066,018 | A | | 11/1991 | Hinton | |
| 5,199,716 | A | * | 4/1993 | DeFluiter | A63B 43/005 273/412 |
| 5,265,883 | A | * | 11/1993 | Choo | A63B 59/20 473/505 |
| 5,294,130 | A | * | 3/1994 | Woods | F41B 15/00 273/348.4 |
| D360,913 | S | * | 8/1995 | Choi | D21/567 |
| D622,325 | S | | 8/2010 | Walterscheid | |
| 8,012,049 | B1 | * | 9/2011 | Walterscheid | F42B 6/003 473/578 |
| D709,559 | S | | 7/2014 | Baumann et al. | |
| D709,560 | S | | 7/2014 | Baumann et al. | |
| 9,091,514 | B1 | | 7/2015 | Cummings | |
| D805,129 | S | | 12/2017 | Nagata | |
| 10,213,932 | B2 | * | 2/2019 | Brobeil | B25G 1/10 |
| 10,724,832 | B2 | * | 7/2020 | Washington | F41J 3/00 |
| 2015/0031266 | A1 | * | 1/2015 | Hochstrasser | A63H 3/04 446/177 |

* cited by examiner

THROWING TOY WITH CONTACT CONNECTOR HEAD

RELATED APPLICATIONS

This application claims the benefit of U.S. Provisional Patent Application No. 62/721,571, filed Aug. 22, 2018.

BACKGROUND OF THE INVENTION

1. Field of the Invention

In general, the present invention relates to action skill toys that are thrown or otherwise propelled toward a target. More particularly, the present invention relates to action skill toys with suction cups or other connection mechanisms that enable the toy to temporality adhere to an impacted surface.

2. Prior Art Description

There are many different types of throwing weapons. To practice the throwing of such weapons, the weapon is traditionally thrown at a target to a target surface, such as a sandbag. The practice of throwing various weapons have evolved into sports. For example, axe throwing has evolved into a popular sport where a person throws an axe or hatchet at a target. The sport has grown in popularity and there are both leagues and practice centers that cater to the sport. Since the sport utilizes sharp axes, the sport is inherently dangerous. As such, the sport is typically not played or practiced by children.

In order to enable children to enjoy the activity of axe throwing and similar weapon throwing activities, a safe toy version of the equipment is required. However, making a toy version of a functional weapon that is safe for a child is problematic. In the prior art, there are many toy projectiles that simulate blade projectiles or pointed projectiles. For example, there are many versions of toy bows and arrows. These toys often replace the blade or point with a suction cup.

The substitution of a suction cup for a blade works if the blade or point is small. On an item, such as an axe, the blade is long and curved. This enables a real axe to stick into a target throughout a relatively large range of impact angles. If one large suction cup were substituted for the blade of the axe, then the axe would only be able to engage a target in a very small range of impact angles. Otherwise, the suction cup would not strike in an orientation that would enable suction. The result is that a toy axe with a single suction cup, would be nearly impossible to get to adhere to a surface. This makes the toy too difficult for children, therein eliminating the play value of the toy.

A need therefore exists for a thrown toy weapon that is safe for children, yet can easily engage a target when thrown. This need is met by the present invention as described and claimed below.

SUMMARY OF THE INVENTION

The present invention is a throwing toy that can simulate the throwing of a weapon, such as an axe, hammer or knife. The throwing toy has a head and a handle that are molded, in whole or in part, from a soft polymeric foam. Reinforcement elements can be molded into the foam to provide structural integrity where needed. The head of the toy has a face surface, a rear surface, a top surface, and a bottom surface. The handle extends from the bottom surface of the head. When the throwing toy is thrown toward a target, one of the surfaces of the head is likely to impact the target.

Contact connectors, such as suction cups, are affixed to at least one of the surfaces of the head. The contact connectors are set at different positions and preferably at different angles to provide contact attachments across a wide range of contact angles.

The throwing toy is thrown toward a target. Upon impact, one of the contact connectors may impact the target at a proper angle for adhesion. If so, the throwing toy adheres to the target. The throwing toy is heavy enough to throw, but has a large size-to-weight ratio. In this manner, the throwing toy cannot cause injury upon impact with a person.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention throwing toy can be embodied in many ways, only a few exemplary embodiments are illustrated and described. The exemplary embodiments set forth some of the best modes contemplated for the invention. The illustrated embodiments, however, are merely exemplary and should not be considered limitations when interpreting the scope of the appended claims.

Figure 1:
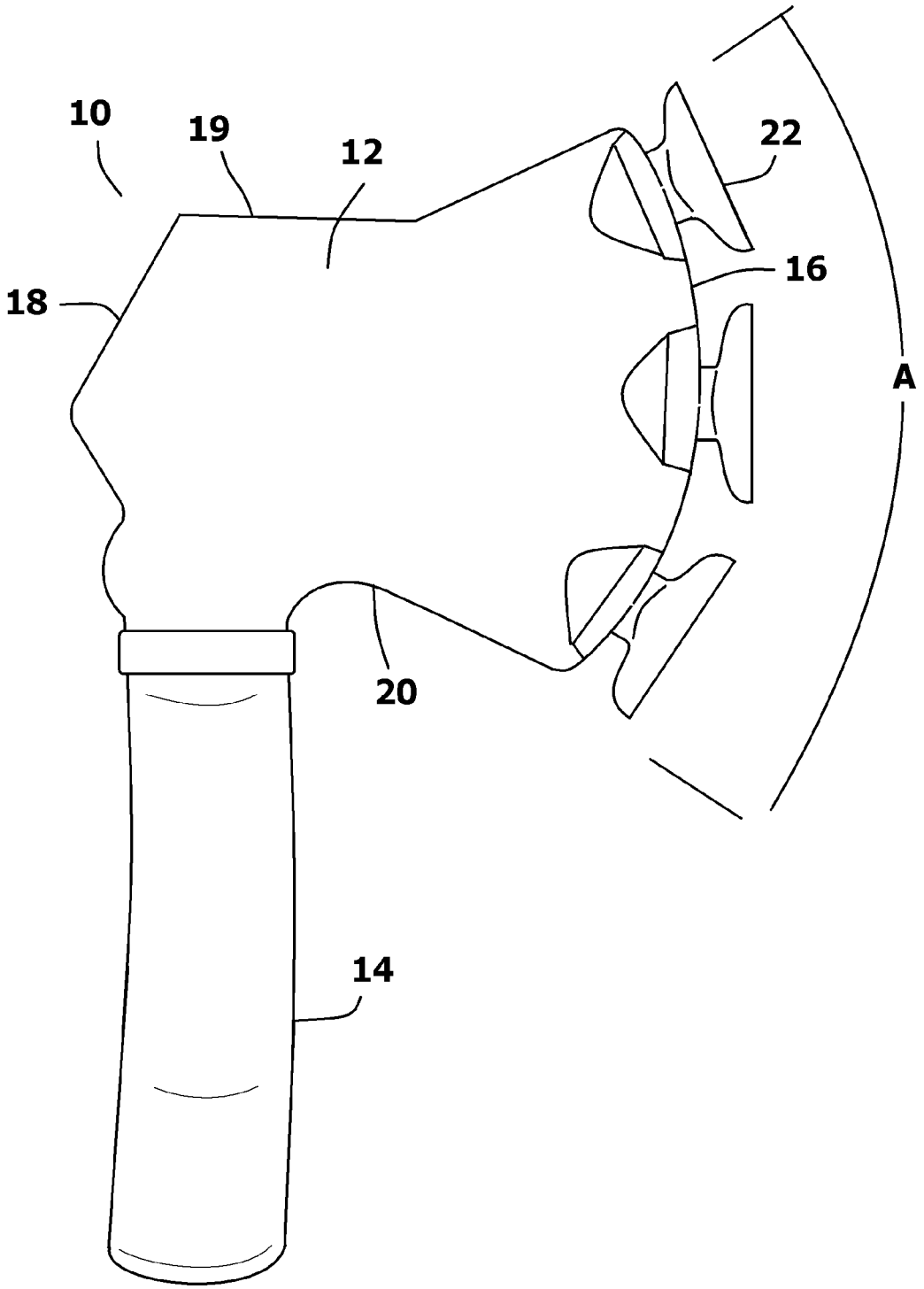
FIG. 1 is a front view of an exemplary embodiment of a throwing toy configured as a single-faced axe.

Referring to FIG. 1, a throwing toy 10 is shown. The exemplary throwing toy 10 being illustrated has the general configuration of an axe. That is, the throwing toy 10 has an axe-shaped head 12 positioned atop a handle 14. Both the axe-shaped head 12 and the handle 14 are made from soft lightweight molded materials. This limits the weight of the throwing toy 10 and provides the throwing toy 10 with a large size-to-weight ratio. In this manner, the throwing toy 10 is not dangerous as a blunt force object, should an individual throw the throwing toy 10 toward another.

The axe-shaped head 12 of the throwing toy 10 has a face edge 16, a rear edge 18, a top edge 19 and a bottom edge 20. The face edge 16 has a length and follows a curve along that length. A plurality of suction cups 22 are attached to the face edge 16. The suction cups 22 are linearly aligned along the face edge 16. The suction cups have the ability to adhere to smooth, semi-smooth and even some rough surfaces for various periods of time. Due to the curved nature of the face edge 16, the suction cups 22 are each arranged at slightly different angles of inclination. It is preferred that at least one of the suction cups 22 be oriented at a perpendicular to the primary direction in which the handle 14 extends. In the shown embodiment, three suction cups 22 are provided. Such a number is arbitrary, and it will be understood that any plurality of suction cups 22 can be used. The combined angles of inclination for all the suction cups 22 extend across an arcuate range A. The arcuate range A is preferably between thirty degrees and eighty degrees. The arcuate range A depends upon the length of the face edge 16, the size of the suction cups 22 and the number of suction cups 22.

The handle 14 extends from the bottom edge 20 of the axe-shaped head 12. The handle 14 has a length that is at least as long as the width of the axe-shaped head 12 between the face edge 16 and the rear edge 18. The handle 14 is preferably molded with the axe-shaped head 12 as a single unit to prevent the need for assembly.

Figure 2:
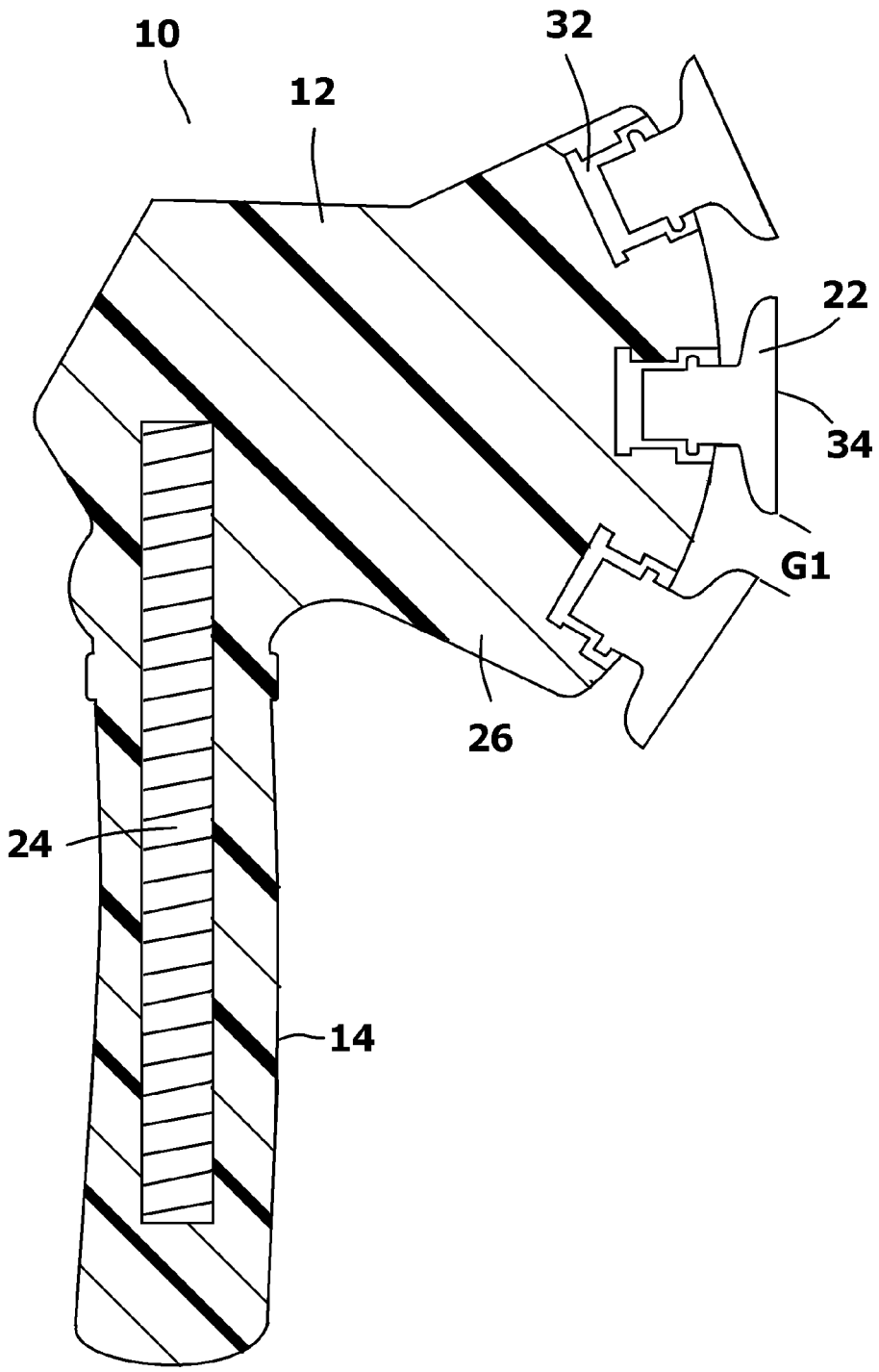
FIG. 2 is a cross-sectional view of the exemplary embodiment of FIG. 1.
Figure 3:
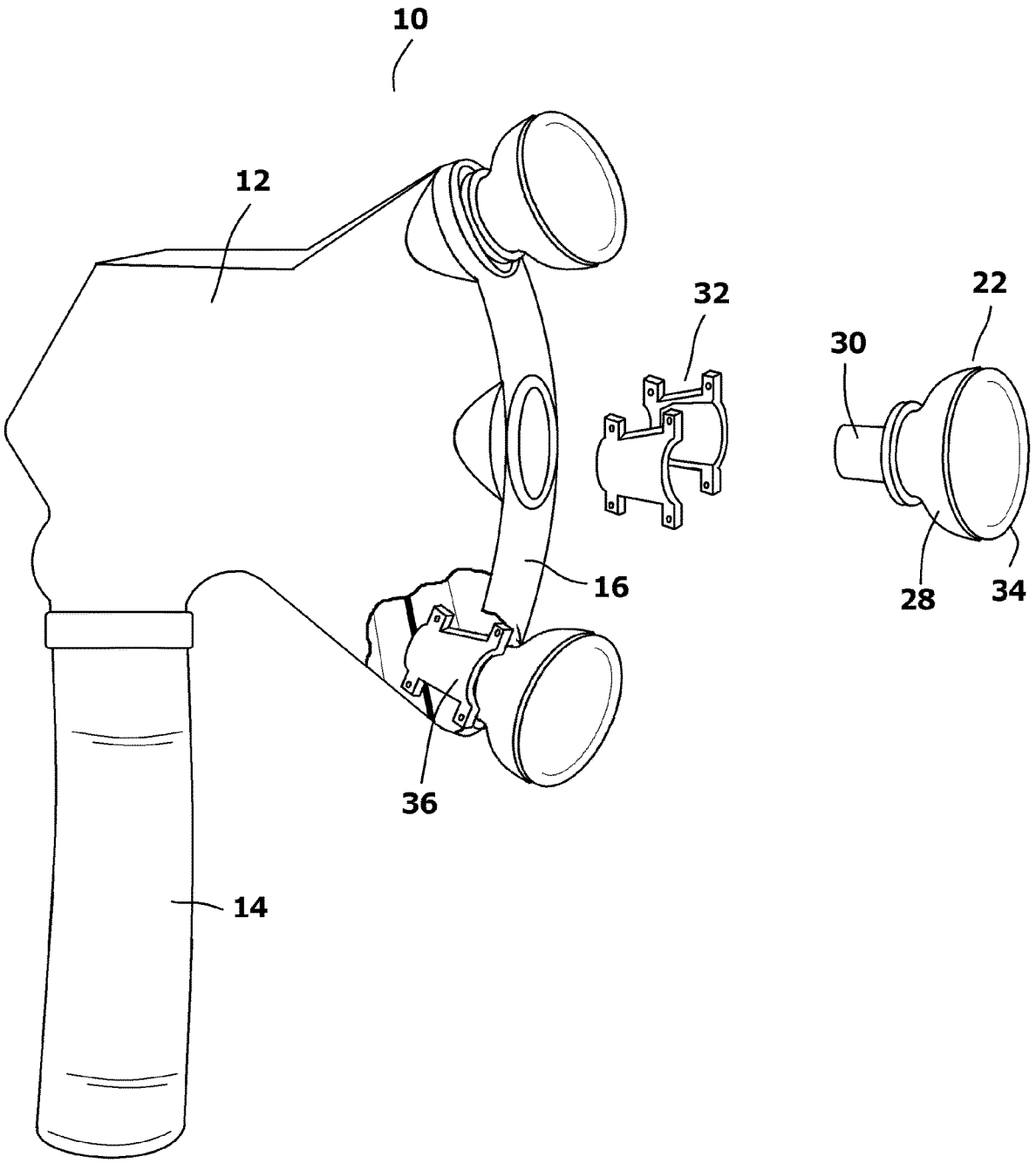
FIG. 3 is an exploded view of the exemplary embodiment of FIG. 1.

Referring to FIG. 2 and FIG. 3 in conjunction with FIG. 1, it will be understood that the handle 14 and the axe-shaped head 12 are mostly molded from a lightweight polymeric foam 26. This makes both the handle 14 and the axe-shaped head 12 lightweight. The polymeric foam 26 also provides the exterior surfaces of the handle 14 and the axe-shaped head 12 with a high degree of impact softness. Many polymeric foams have limited structural strength. To provide better structural integrity to the throwing toy 10, at least one reinforcement element 24 can be provided within the polymeric foam 26. The reinforcement element 24 provides strength and stiffness to the handle 14 and to the transition between the handle 14 and the axe-shaped head 12. The reinforcement element 24 is completely encased within the polymeric foam 26. As such, the rigid plastic is not a danger should the throwing toy 10 impact a person or delicate object.

Each suction cup 22 includes a cup head 28 and a cup stem 30. The cup stem 30 is engaged by a clamshell mold anchor 32. The suction cups 22 are separately molded from a suitable polymer or polymeric foam. The cup head 28 has a nominal diameter across a base rim 34. The diameter of the base rim 34 expands when the cup head 28 is compressed against a smooth surface.

In design, the cup heads 28 are set at different angles, where the plane of each base rim 34 is parallel to the tangent of the curved face edge 16 of the axe-shaped head 12. Furthermore, each of the suction cups 22 are spaced so that the cup heads 28 are separated by a gap distance G1. This gap distance G1 provides the cup heads 28 with space needed to expand on impact without any overlapping.

Each suction cup 22 has a cup stem 30 that is mechanically engaged by a clamshell mold anchor 32. The clamshell mold anchor 32 closes around the cup stem 30, therein preventing the cup stem 30 from separating from the clamshell mold anchor 32. The clamshell mold anchors 32 are separately molded from a plastic that has a melting point significantly higher than that of the polymeric foam 26 used in the axe-shaped head 12 of the throwing toy 10.

In manufacturing, the suction cups 22 are separately molded. The cup stems 30 of the suction cups 22 are then captured within the clamshell mold anchors 32, forming suction cup subassemblies 36. The suction cup subassemblies 36 and any reinforcement elements 24 are placed within an injection molding machine that uses an insert mold. The polymeric foam 26 is injected into the mold, wherein the polymeric foam 26 envelops the clamshell mold anchors 32 and the reinforcement elements 24. The result is a throwing toy 10 with an axe-shaped head 12 and a handle 14 made of polymeric foam 26 and a plurality of suction cups 22 extending from the curved face edge 16 of the axe-shaped head 12.

Figure 4:
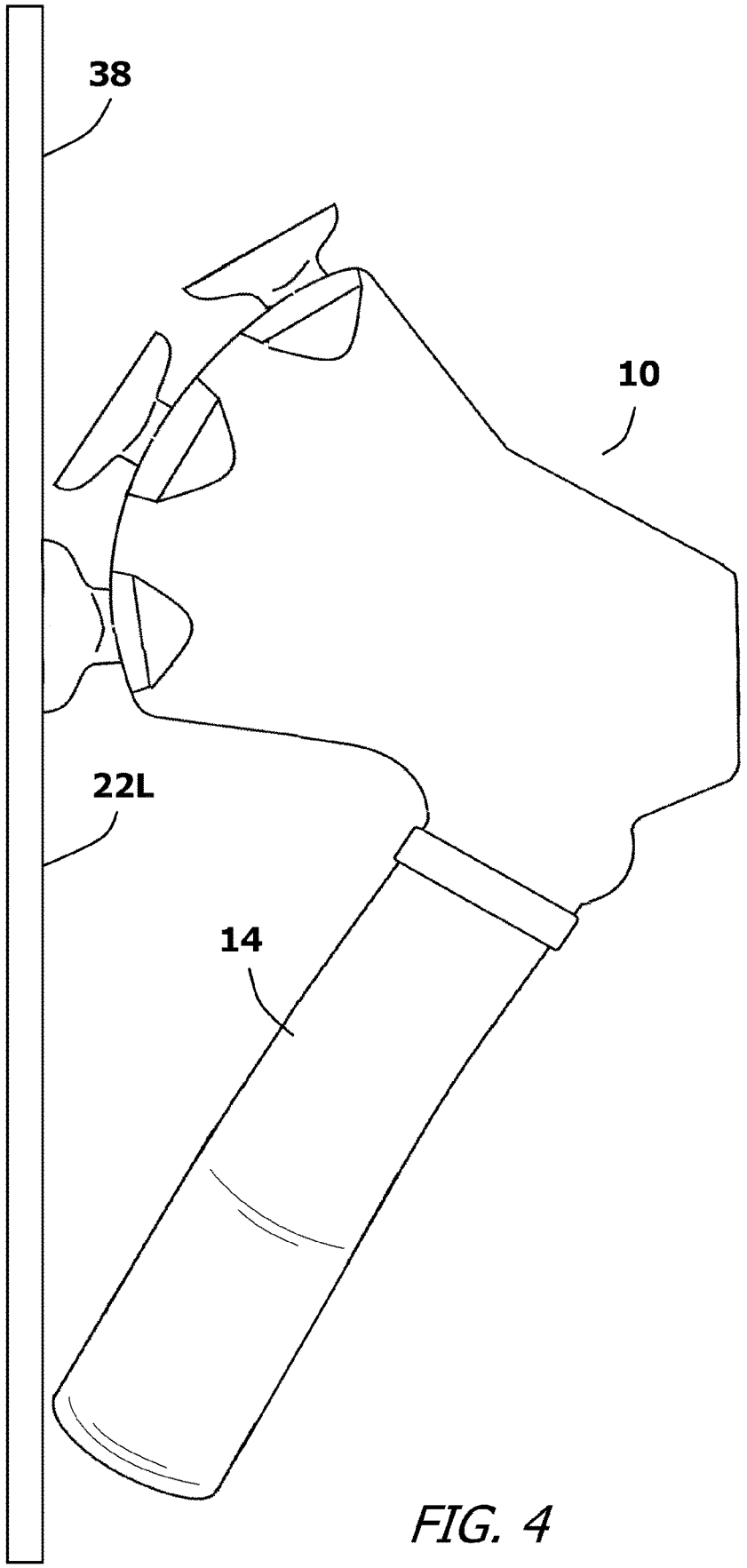
FIG. 4 shows the exemplary embodiment of FIG. 1 engaged with a flat target surface to show handle orientation.

Referring to FIG. 4, the throwing toy 10 is shown attached to a flat target surface 38 at the lowest of the suction cups 22L. It will be understood that the position of the lowest suction cup 22L and the length and angle of the handle 14 are interdependent. These elements are engineered so that the lowest suction cup 22L can adhere to the flat target surface 38 without interference by the handle 14. That is, the handle 14 cannot extend beyond the plane of the base rim 34 of the lowest suction cup 22L.

Figure 5:
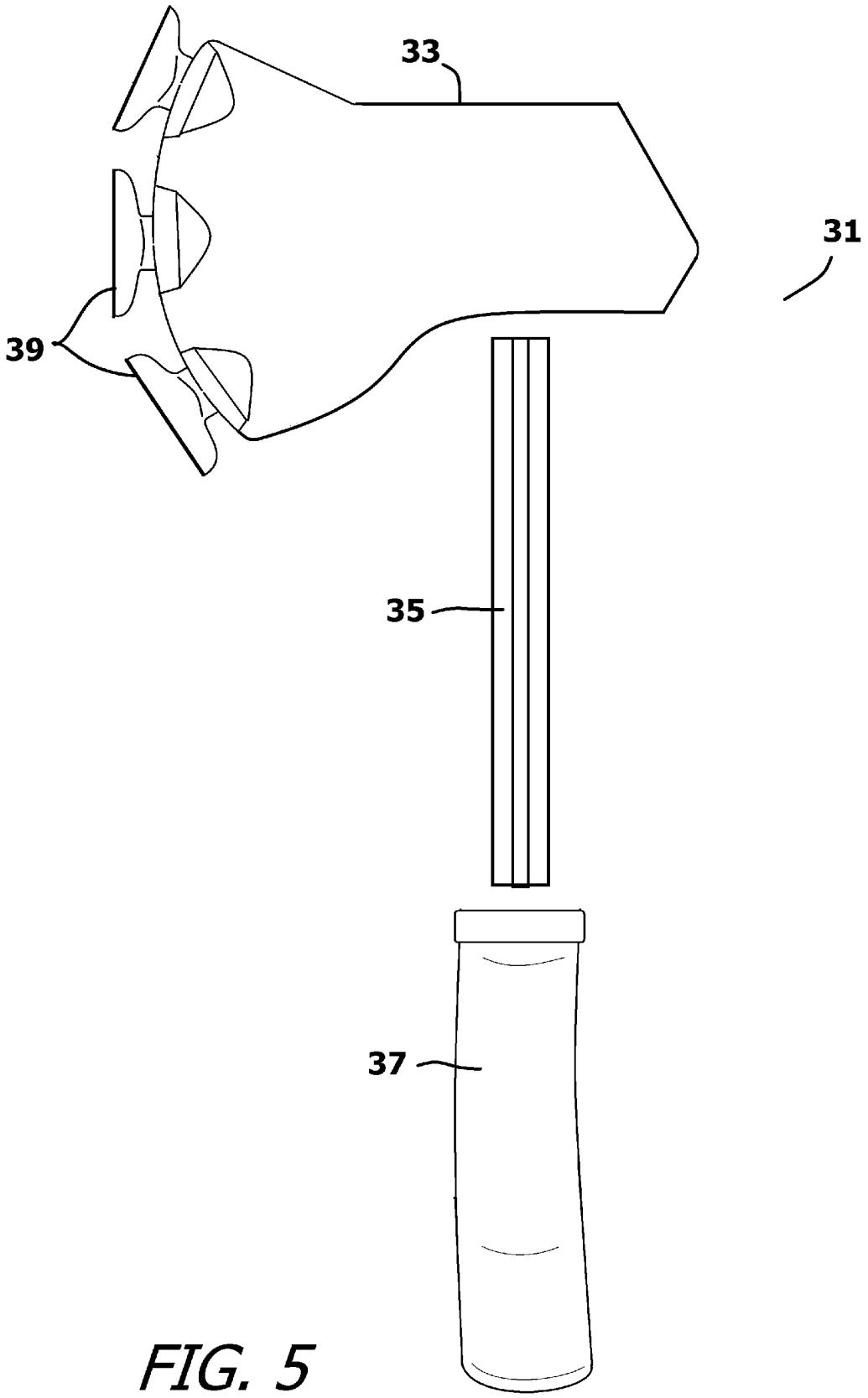
FIG. 5 is an alternate exemplary embodiment of a throwing toy, showing an alternate construction technique.

Referring to FIG. 5, an alternate embodiment of a throwing toy 31 is shown. In this embodiment, an axe-shaped head 33, the handle 35, and a handle grip 37 are separately manufactured. The axe-shaped head 33 and handle grip 37 are made from soft foam material. The handle 35, however, can be made from a more rigid plastic. The axe-shaped head 33 and handle grip 37 are then affixed to the handle 35 in a secondary assembling step. The axe-shaped head 33 contains suction cups 39 that are set into the axe-shaped head 33 in the same manner as was previously described in the earlier embodiment.

Figure 6:
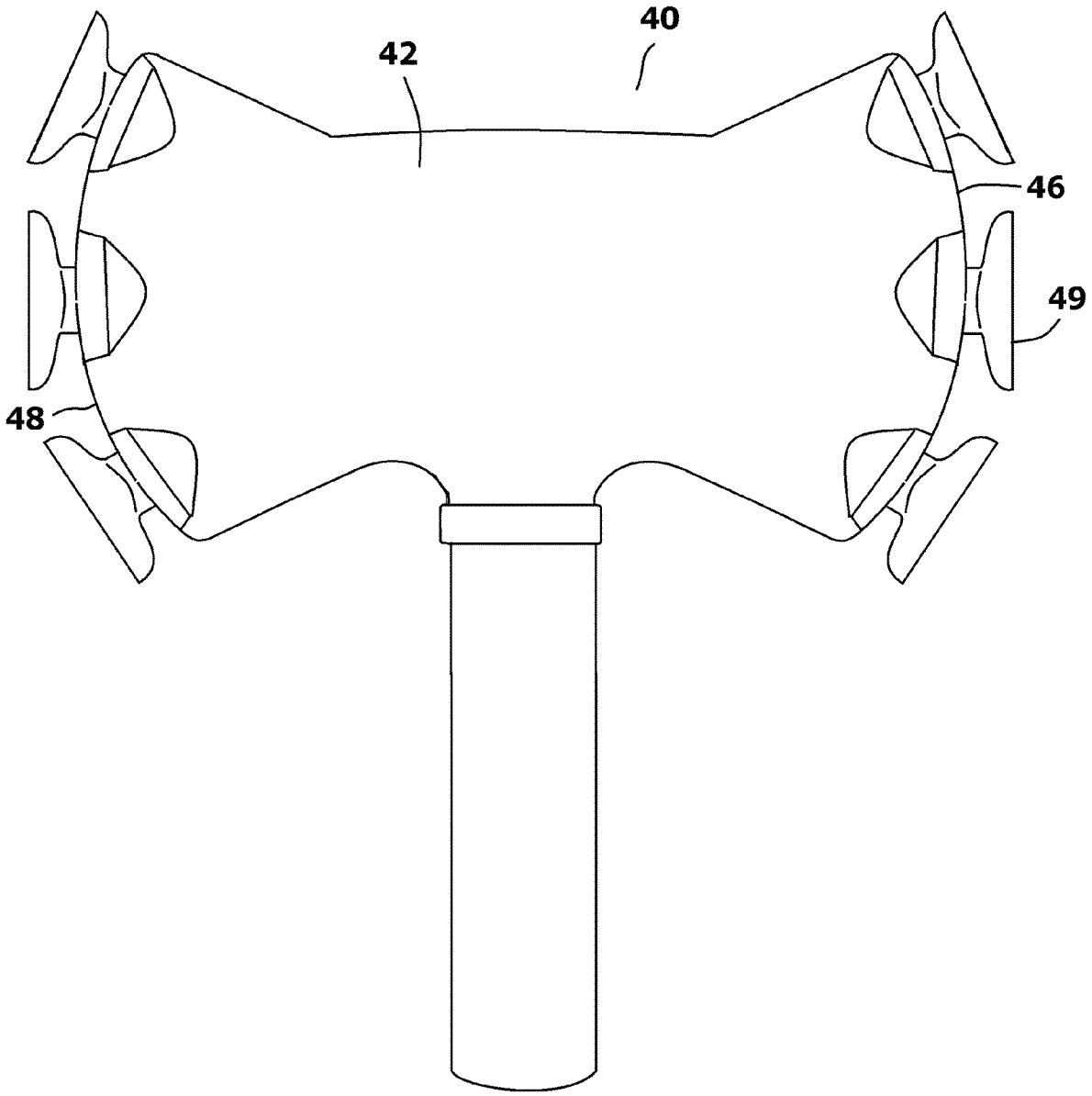
FIG. 6 is an alternate exemplary embodiment of a throwing toy configured as a double-faced axe.

Referring to FIG. 6, an alternate embodiment of a throwing toy 40 is shown. In this embodiment, an axe-shaped head 42 is affixed to a handle 44. However, the axe-shaped head 42 has two face edges 46, 48. Both face edges 46, 48 contain suction cups 49.

Figure 7:
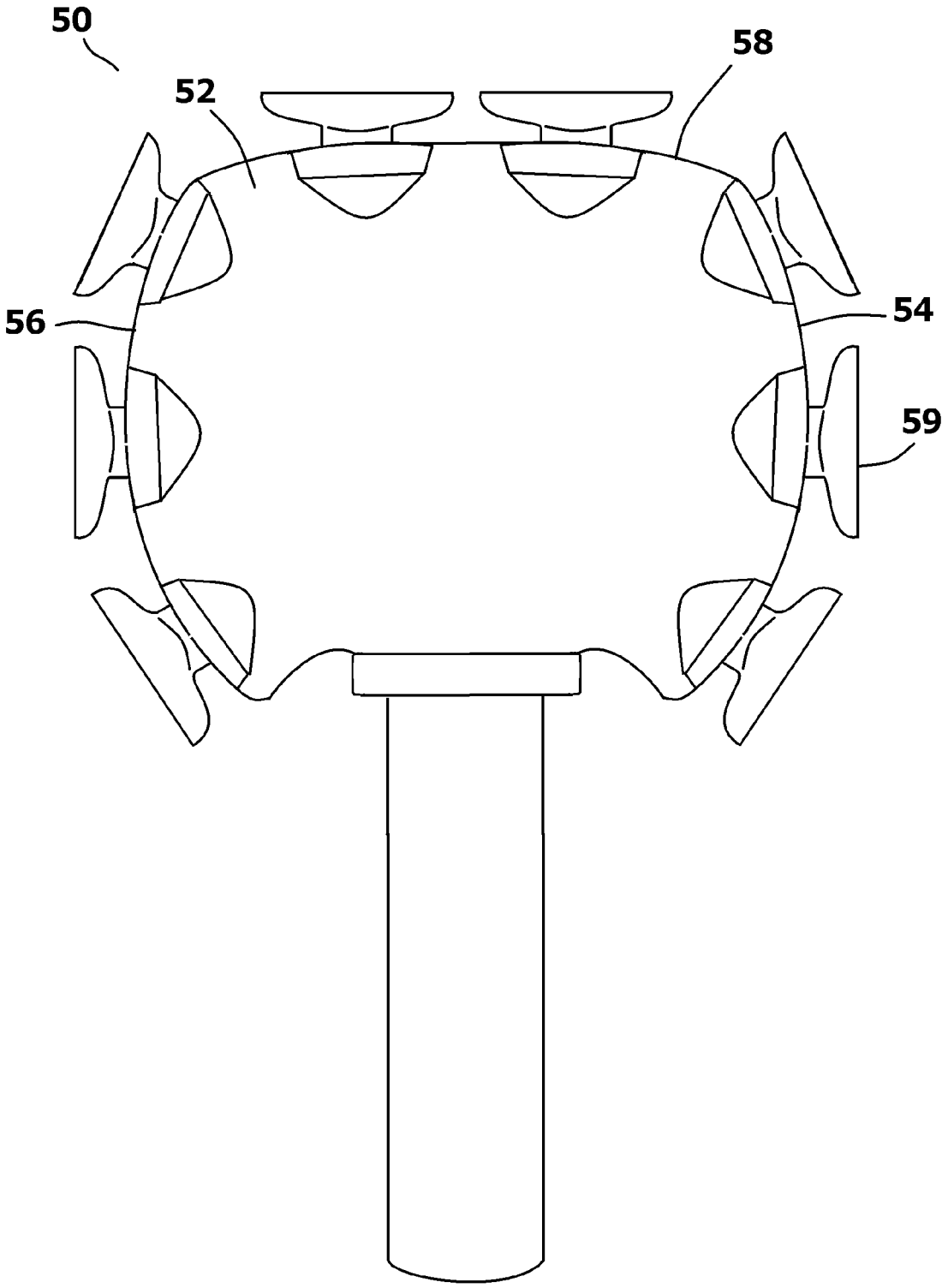
FIG. 7 is an alternate exemplary embodiment of a throwing toy configured as a war hammer.

Referring to FIG. 7, another embodiment of a throwing toy 50 is shown, wherein the throwing toy 50 is configured as a war hammer. The throwing toy 50 has a head 52 with two side edges 54, 56 and a top edge 58 that may strike a surface when thrown. Suction cups 59 are attached to the two side edges 54, 56 and the top edge 58. In this manner, the throwing toy 50 can adhere to a surface in a 180-degree rotational range.

Figure 8:
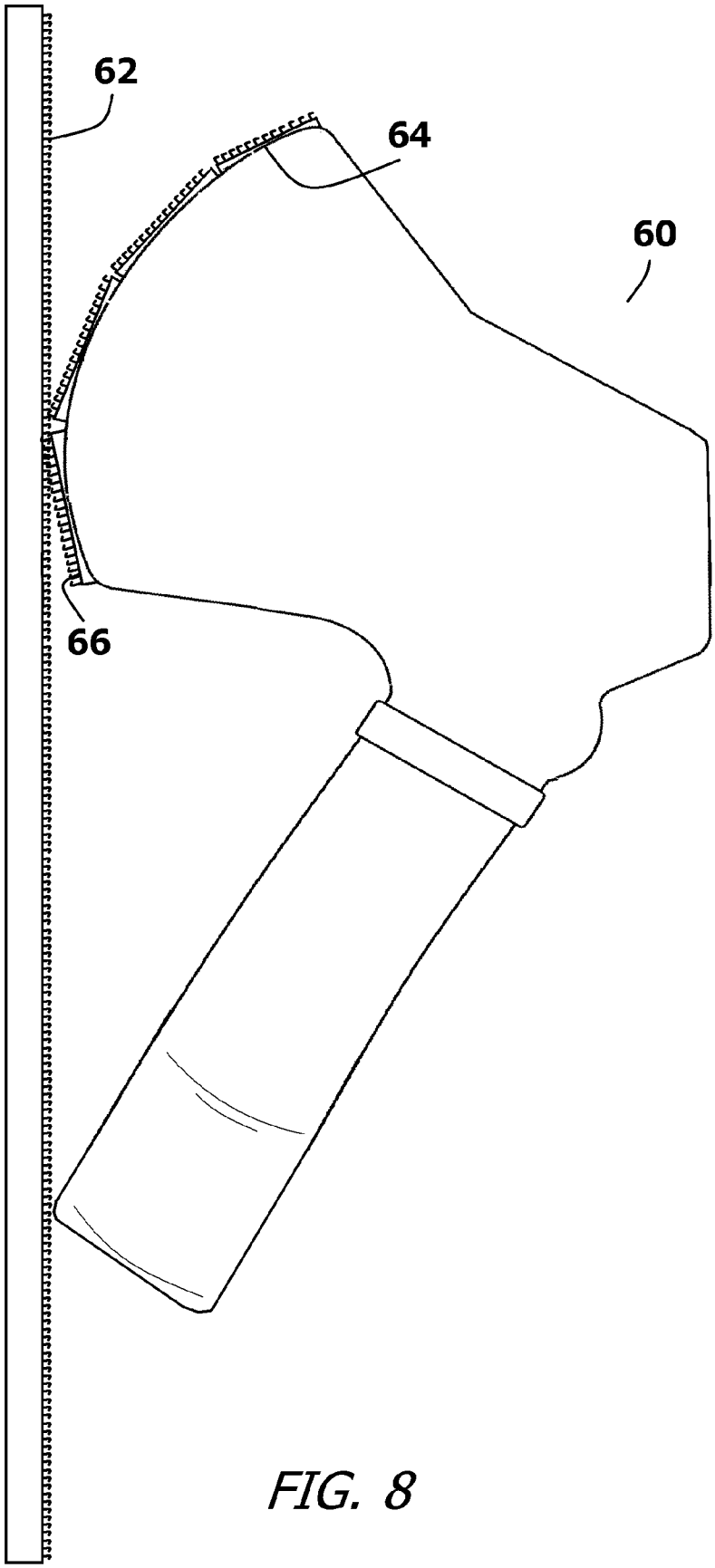
FIG. 8 is an alternate exemplary embodiment of a throwing toy containing hook and loop contact connectors.
Figure 9:
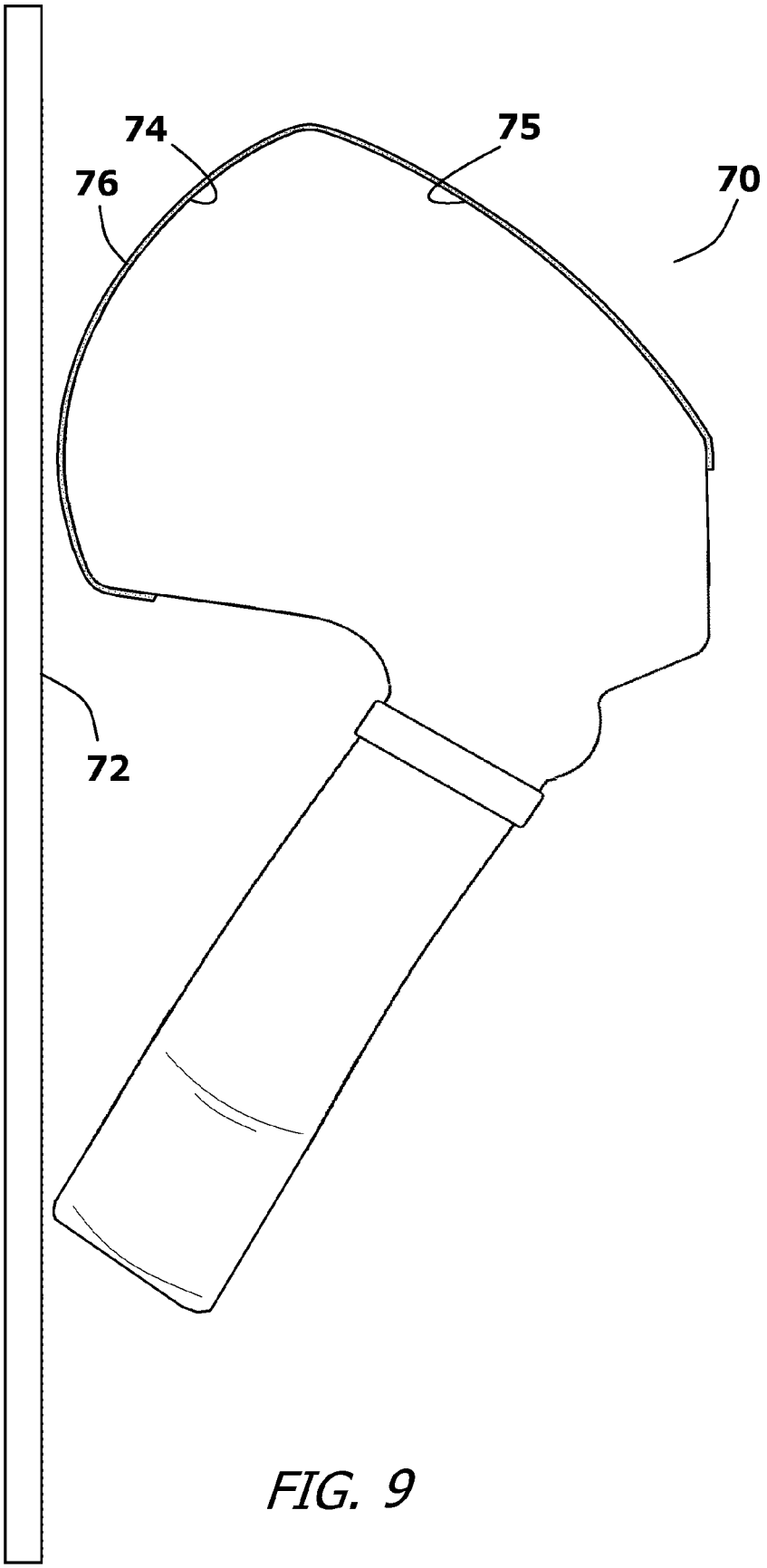
FIG. 9 is an alternate exemplary embodiment of a throwing toy containing tacky material contact connectors.

Suction cups are only one type of contact connector that is available to a toy manufacturer. Other contact connectors include hook and loop contact connectors, magnets connectors, and tacky adhesive connectors. All of these contact connectors can be adapted for use as part of the present invention. Two such embodiments are shown in FIG. 8 and FIG. 9. Referring to FIG. 8, a throwing toy 60 is shown in conjunction with a target 62. The throwing toy 60 is shaped as an axe with one curved face edge 64. The curved face edge 64 is flattened and is covered with a contact connector 66 of hook and loop material, such as Velcro®. The target 62 is covered with the opposite component. As such, should the face edge 64 of the throwing toy 60 contact the target 62, the throwing toy 60 will adhere to the target 62.

Referring to FIG. 9, a throwing toy 70 is shown in conjunction with a target 72. The throwing toy 70 is shaped as an axe with one curved face edge 74 and a top surface 75. The curved face edge 74 and the top surface 75 are covered in a contact connector in the form of a continuous strip of a tacky adhesive material 76. The throwing toy 70 is thrown at the target 72. Should the tacky adhesive material 76 contact the target 72, the throwing toy 70 will adhere to the target 72 with enough force to support the weight of the throwing toy 70.

It will be understood that the embodiments of the present invention that are illustrated and described are merely exemplary and that a person skilled in the art can make many variations to those embodiments. For instance, the size, shape and style of the toy throwing assembly can be changed. All such embodiments are intended to be included within the scope of the present invention as defined by the claims.

What is claimed is:

1. A throwing toy, comprising:

a head having a curved face surface that extends between a top surface, and a bottom surface, and a rear surface opposite said face surface, wherein said head has a maximum width between said face surface and said rear surface;

a handle extending from said bottom surface of said head, wherein said handle has a length that is at least as long as said maximum width of said head; and a plurality of suction cups extending from said curved face surface of said head, said plurality of suction cups having a first suction cup that is closest to said bottom surface of said head, wherein said first suction cup has a base rim that extends in a plane, wherein said handle is positioned so as not to pass through said plane, and wherein each of said suction cups is set into a mount that is molded within said head.

2. The throwing toy according to claim 1, wherein said curved face surface of said head has a length between said top surface and said bottom surface, wherein said plurality of suction cups are equally spaced along said length.

3. The throwing toy according to claim 1, wherein said handle extends from said head in a primary direction and said plurality of suction cups contains a suction cup oriented at a perpendicular to said primary direction.

4. The throwing toy assembly according to claim 1, wherein said head and said handle have exterior surfaces molded from a polymeric foam.

5. The throwing toy according to claim 1, wherein said head and said handle are integrally molded as a single unit.

6. The throwing toy according to claim 5, further including a reinforcement element molded within said single unit that extends between said head and said handle.

7. The throwing toy according to claim 1, wherein said plurality of suction cups are linearly aligned along said face surface.

8. The throwing toy according to claim 1, further including a second plurality of suction cups extending from said rear surface of said head.

9. A throwing toy assembly, comprising:

a head having a face surface, a rear surface, a top surface, and a bottom surface, wherein said face surface has a curved length;

a handle extending from said bottom surface of said head; and a plurality of suction cups extending from said face surface of said head at different angles relative said handle, wherein each of said plurality of suction cups has a base that extends in a different plane, wherein said handle does not intersect any said plane and wherein each of said suction cups is set into a mount that is molded within said head.

10. The throwing toy assembly according to claim 9, wherein said head and said handle have exterior surfaces molded from a polymeric foam.

11. The throwing toy according to claim 9, wherein said head and said handle are integrally molded as a single unit.

12. The throwing toy according to claim 11, further including a reinforcement element molded within said single unit that extends between said head and said handle.

13. A throwing toy, comprising:

a foam head having a curved face surface;

a plurality of suction cups extending from said curved face surface, wherein each of said plurality of suction cups has a base that is arranged in an plane that is tangential to said curved face surface, wherein said plurality of suction cups enable said throwing toy to adhere to a surface upon impact and wherein each of said suction cups is set into a mount that is molded within said head; and a handle extending from said head, wherein said handle does not traverse through any said plane.

* * * * *